US009585472B2

(12) United States Patent
O'Connell, Jr.

(10) Patent No.: US 9,585,472 B2
(45) Date of Patent: Mar. 7, 2017

(54) ADAPTIVE FURNITURE

(71) Applicant: John F. O'Connell, Jr., Framingham, MA (US)

(72) Inventor: John F. O'Connell, Jr., Framingham, MA (US)

( * ) Notice: Subject to any disclaimer, the term of this patent is extended or adjusted under 35 U.S.C. 154(b) by 0 days.

(21) Appl. No.: 14/683,947

(22) Filed: Apr. 10, 2015

(65) Prior Publication Data

US 2016/0296014 A1 Oct. 13, 2016

(51) Int. Cl.

| | |
|---|---|
| ***A47B 85/00*** | (2006.01) |
| ***A47B 96/02*** | (2006.01) |
| ***A47C 19/00*** | (2006.01) |
| ***A47B 47/00*** | (2006.01) |
| ***A47B 3/06*** | (2006.01) |
| ***A47C 13/00*** | (2006.01) |
| ***A47C 16/02*** | (2006.01) |

(52) U.S. Cl.

CPC ..... *A47B 85/00* (2013.01); *A47B 3/06* (2013.01); *A47B 47/0091* (2013.01); *A47B 96/025* (2013.01); *A47C 13/00* (2013.01); *A47C 16/02* (2013.01); *A47C 19/005* (2013.01)

(58) Field of Classification Search

CPC ..... A47B 85/00; A47B 3/06; A47B 96/025; A47B 47/0091; A47B 3/00; A47B 47/06; A47B 47/047; A47B 87/02; A47B 7/0207; A47C 4/02; A47C 19/005; A47D 11/00; A61G 5/006

USPC ..... 312/107, 108, 240, 235.4; 108/14

See application file for complete search history.

(56) References Cited

U.S. PATENT DOCUMENTS 460,748 A * 10/1891 Hartman ..... A47B 7/02 108/91
1,423,714 A * 7/1922 Fry ..... F25D 7/00 312/107
1,833,081 A * 11/1931 Kilmer ..... B65D 25/06 217/36
3,564,787 A * 2/1971 Sherman ..... A47B 87/0253 434/79
3,834,776 A * 9/1974 Becker, Jr. ..... A47B 85/00 297/118
3,841,727 A * 10/1974 Peng ..... A47B 47/0091 190/11
4,062,301 A * 12/1977 Pitchford ..... B23P 19/041 108/54.1
4,186,452 A * 2/1980 Underwood ..... A47C 19/005 5/400
4,236,460 A * 12/1980 Poupko ..... A47B 85/00 108/162
4,319,370 A * 3/1982 Robinson ..... A47C 19/005 108/56.1
4,675,929 A * 6/1987 Santo ..... A47C 19/005 108/185
4,768,661 A * 9/1988 Pfeifer ..... A47F 5/005 211/184
5,070,556 A * 12/1991 Gloger ..... A47C 17/86 16/35 R
5,273,248 A * 12/1993 Grander ..... A47B 85/00 211/2

(Continued)

*Primary Examiner* — David E Sosnowski
*Assistant Examiner* — Eric Kurilla
(74) *Attorney, Agent, or Firm* — Nils Peter Mickelson

(57) ABSTRACT

A simple, low cost, easy to clean adaptive furniture set is provided, affording a variety of furniture configurations including a bed, a chair or a shelf storage unit. This modular set is particularly useful for students, low-income families, and transient or refugee populations.

2 Claims, 3 Drawing Sheets

(56) References Cited

U.S. PATENT DOCUMENTS 5,469,589 A * 11/1995 Steed ..... A47C 19/005 5/201
8,007,059 B2 * 8/2011 Karl ..... A47C 16/02 108/147.11
2004/0078896 A1 * 4/2004 Hellyer ..... A47C 19/005 5/400
2004/0108291 A1 * 6/2004 Trent ..... A47C 19/005 211/189
2005/0040307 A1 * 2/2005 Palmer ..... A47B 96/021 248/346.02
2011/0203050 A1 * 8/2011 Rogers ..... A47C 19/025 5/285
2012/0104824 A1 * 5/2012 Skahan ..... A47B 7/02 297/440.14
2012/0222215 A1 * 9/2012 Chang ..... A47C 19/005 5/114
2012/0242200 A1 * 9/2012 Keragala ..... A47B 47/042 312/111
2013/0080286 A1 * 3/2013 Rotholz ..... A47C 5/005 705/26.5
2013/0234576 A1 * 9/2013 Hixson ..... A47C 13/005 312/265.5
2013/0257234 A1 * 10/2013 Kumar ..... A47C 17/54 312/7.2
2014/0135193 A1 * 5/2014 Albarran-Torres .... A47B 47/06 493/390
2014/0373357 A1 * 12/2014 Elliott ..... B23P 11/00 29/897
2015/0053635 A1 * 2/2015 Ahart ..... A47B 47/0091 211/188
2015/0196121 A1 * 7/2015 Chan ..... A45F 5/12 312/107
2015/0320201 A1 * 11/2015 Meadows ..... F16B 12/2009 108/64
2015/0320207 A1 * 11/2015 Chan ..... A47B 87/0276 312/108
2015/0342341 A1 * 12/2015 Glekas ..... A47B 47/0091 312/111

* cited by examiner

Fig. 1
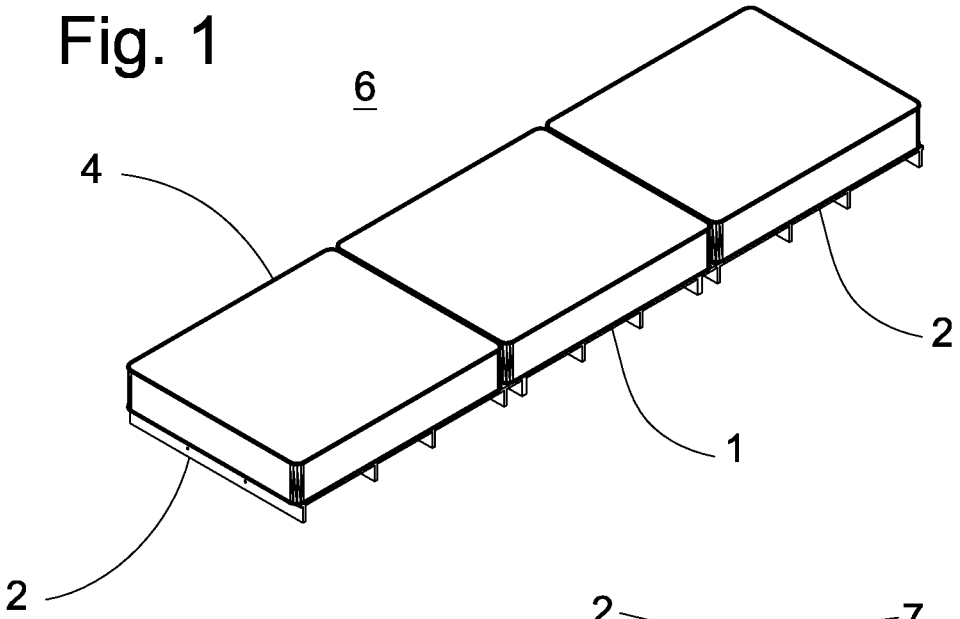
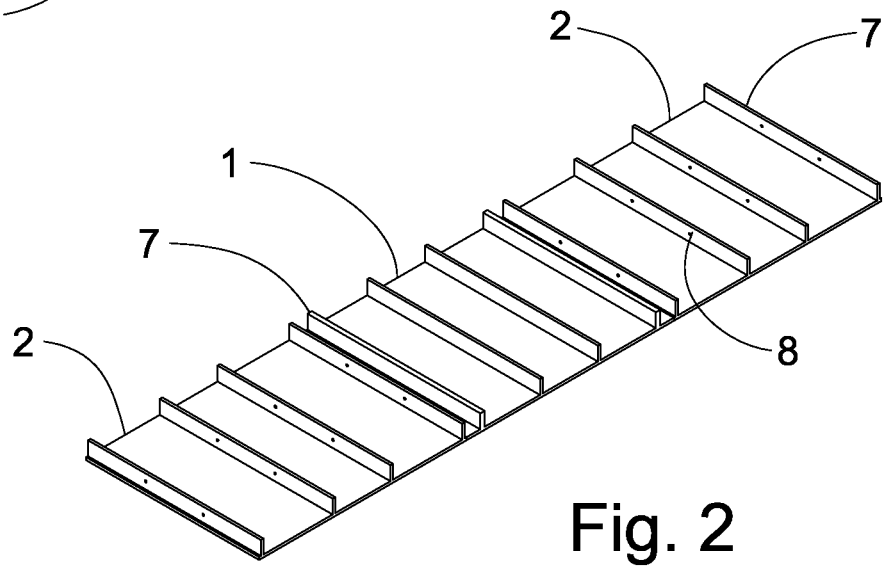
Fig. 2

ADAPTIVE FURNITURE

CROSS REFERENCE TO RELATED APPLICATIONS

62/010,116

FEDERALLY SPONSORED RESEARCH none

SEQUENCE LISTING none

BACKGROUND OF THE INVENTION

With recent economic trends, people are increasingly being dislocated from traditional nuclear family living into the need for more flexible living arrangements. Not only are young family members leaving home for college, but also these same folks are often unable to find employment that avails them of their own homes as adults. The relative cost of home maintenance versus personal income is changing, and with it the need for low cost, easily transported and reconfigurable furniture.

FIELD OF THE INVENTION

Beyond this economic trend is an increasing number of transient endangered people fleeing away from unsafe economically, militarily or health threatened areas and into safer but more crowded regions where living quarters must be hastily created and protected against the spread of contagious disease.

DESCRIPTION OF THE INVENTION

My invention is an adaptable set of modules that can be arranged in several ways to provide a place to sleep, a table for eating, chairs of a simple Japanese zabuton style, or a set of shelves for the storage of items. This invention comprises four separate components—two types of base units, one type of cushion, and one type of shelf. As a kit, these could be purchased as a set of one central base unit, two end base units, three shelves and a handful of fasteners to hold them together in various configurations. Individual components such as clean cushions could be purchased separately as needed.

Each base unit is fabricated, either as a single piece or as a structural equivalent pre-assembled from separate parts. Cost, simplicity and ease of cleaning are all major factors; therefore, this description will be arbitrarily exemplified by the case of single-piece molded parts. Each base unit is a flat panel provided on one of its two flat surfaces with several rectangular ribs. When placed on a floor horizontally and aligned end-to-end, with one central base unit situated between each of two end base units, this assemblage of three units forms the shape and size of a bed—for example 25 inches wide by 90 inches long—and provides a flat horizontal surface raised above the floor that can hold a trio of cushions that together form a mattress for sleeping.

For more dedicated installations, a series of such adjacent beds can be lined up side-to-side to accommodate a large number of people, as in a homeless shelter. The trio of cushions could of course be economically replaced by single full-length mattress cushions instead. Raised above the floor level, as it is, this bed affords protection against insects, fluid spills and cold floor-level air.

When used individually, each of the three base units with its associated cushion can serve as a kneeling pad or serve the function of a traditional Japanese zabuton chair used around a low eating table so that the diners may rest in a comfortable seiza kneeling position.

Assembled differently, each of the two end base units may be arranged vertically on one edge, standing on the floor, spaced and supported across their top edges by the central base unit to form a shelf support. Each rib, aligned parallel to the floor, provides a ledge for supporting a shelf. Equipped with several shelves, the assemblage provides a storage unit or bookcase.

Holes may be provided as appropriate to secure the various parts together and in position, using any set of conventional fasteners such as screws or removable pins or rivets. Likewise, surface fasteners such as hook-and-loop tape, straps or temporary adhesive can also serve to hold the cushions in position.

LISTING OF THE ITEMS SEEN IN THE ILLUSTRATIONS

1—Central Base Unit
2—End Base Unit
3—Shelf
4—Cushion
5—Fasteners
6—Bed Assembly
7—Rectangular Ribs
8—Holes for Assembly
9—Shelf Assembly
10—Zabuton Chair Assembly

EXPLANATION OF THE ILLUSTRATIONS

FIG. 1 is an orthogonal view of the complete bed assembly showing the central base unit, flanked on either end by one each of the two end base units, and topped by the three cushions.

FIG. 2 is an orthogonal view of the three base units assembled as in FIG. 1, but inverted to reveal their bottom faces, showing their several rectangular ribs.

Figure 3:
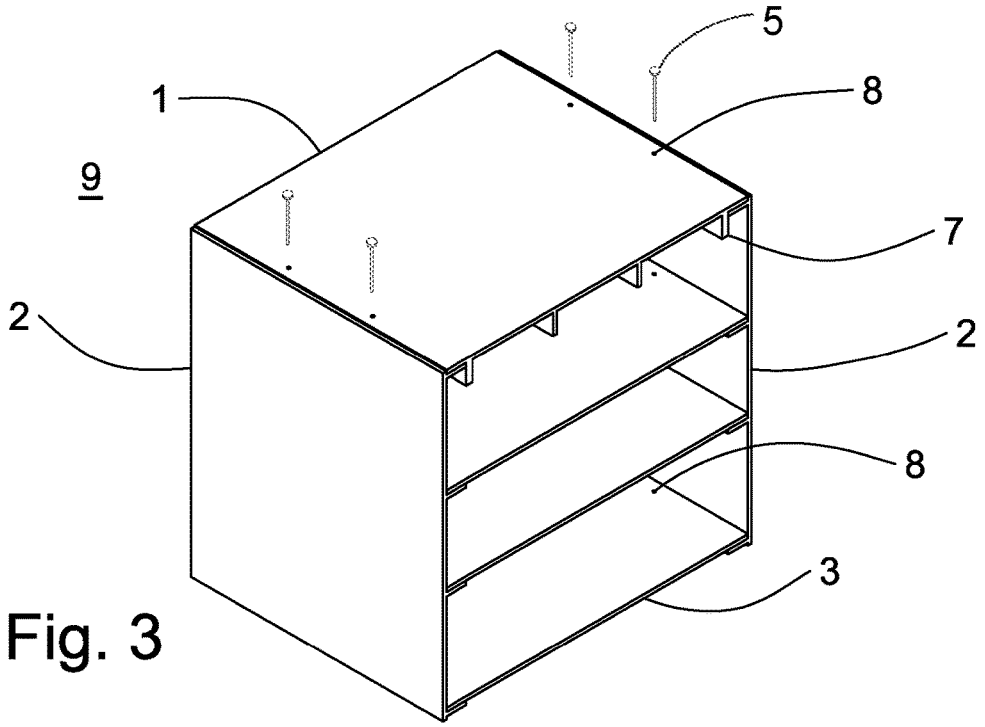
FIG. 3 is an orthogonal view of the fully assembled shelf assembly.
Figure 4:
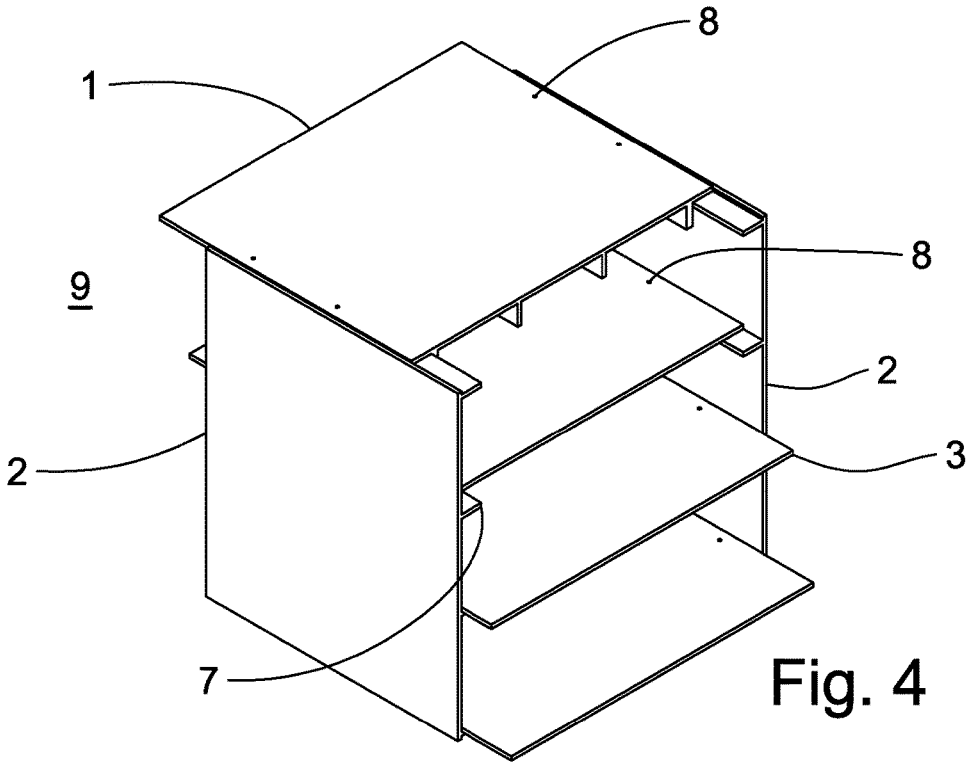
FIG. 4 is an orthogonal view of the shelf assembly, partially assembled.
Figure 5:
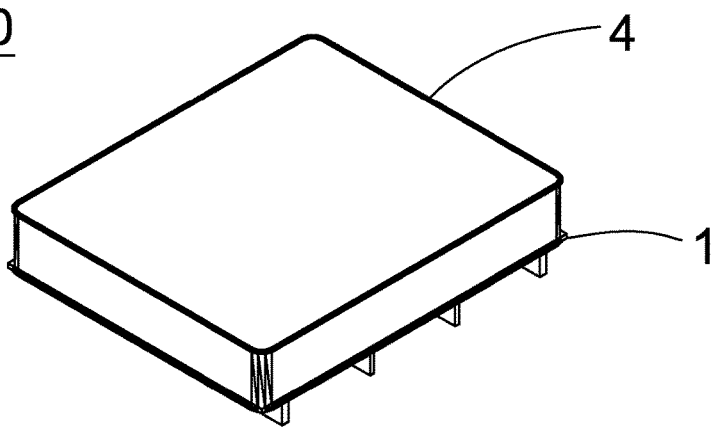
FIG. 5 is an orthogonal view of the central base unit arranged with one cushion to form a zabuton chair. Each of the two end base units can serve similarly.
Figure 6:
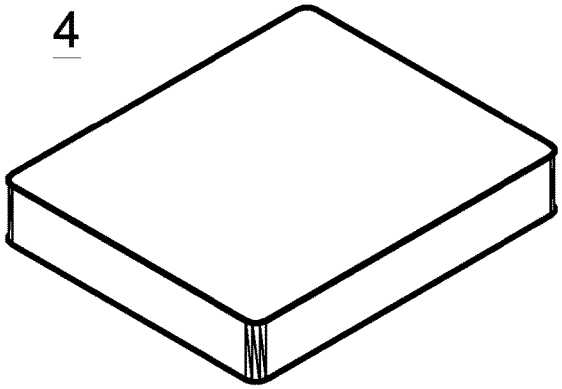
FIG. 6 is an orthogonal view of a typical cushion as would be used on the chair or the bed assembly.
Figure 7:
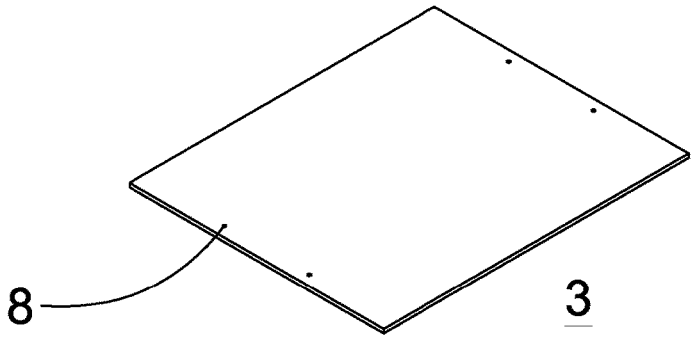
FIG. 7 is an orthogonal view of one exemplary shelf.

It should be understood that these parts may be constructed in any of several ways. For example, additional features could be included in each of the several parts to permit additional combinations and permutations beyond those described here, or to strengthen the parts to serve more robust purposes. Unitary molded or extruded base units designed to avoid capillary action between separate parts afford simplicity, low cost and can be easily sterilized between occupants.

I claim:

1. A modular furniture set comprising three substantially planar modules, (a) the first of said three modules being a central base module, (b) the second and third of said three modules each being an end base module, wherein each of said substantially planar modules is a rectangular flat panel comprising a first surface and an opposing second surface, said first surface being planar and flat, and said second surface provided with a plurality of straight ribs each of rectangular cross-section and characterized by its thickness, its width and its overall axial length, two of said straight ribs each being located proximate and parallel to each of two opposing edges of said rectangular modules, and wherein said three substantially planar modules are fastened together to form a freestanding open box-shaped structure, each of said two end base modules removably fastened perpendicularly along opposing edges of said central base module using removable fastening means, each of said three modules oriented so that their rectangular ribs all run parallel to one another, their axial lengths extending horizontally, and are all on the inner surfaces of the open box-shaped structure thus formed, said open box-shaped structure thus presenting a smooth outer surface and a series of opposing inward-facing parallel ribs on its inner surfaces, said ribs providing sliding support for removable shelves placed therein.

2. A modular furniture set comprising three separate rectangular planar flat panels, each said separate rectangular flat panel having a first rectangular surface and an opposing second rectangular surface, a pair of opposing side edges and a pair of opposing mating edges perpendicular to said pair of side edges;

(a) a first of said three rectangular flat panels being a central base unit;

(b) the second and third of said three rectangular flat panels each being an end base unit;

wherein said three rectangular flat panels may be arranged along corresponding mating edges and removably fastened one to the other along said mating edges to form a reconfigurable useful item of furniture;

wherein said second rectangular surface of each flat base unit is planar and flat but is additionally provided with a plurality of parallel spaced narrow thin straight ribs each of rectangular cross-section, each said rib characterized by its length, its width and its thickness;

(a) the length of each said rib extending from one opposing side edge to the opposite opposing side edge of said second planar flat surface, (b) one thin surface of each said rib's rectangular cross-section being coincident to and joined with said second planar rectangular flat surface, (c) two of said thin narrow straight ribs of each flat base being each located proximate to and parallel with each of said two opposing mating edges of each rectangular flat panel, and (d) the remaining narrow straight ribs of each flat base disposed between and parallel with these said two thin narrow straight ribs of each flat base.

* * * * *